US005460433A

United States Patent [19]

Hawley

[11] Patent Number: 5,460,433

[45] Date of Patent: Oct. 24, 1995

[54] SKATE WHEELS

[76] Inventor: Peter Hawley, 35 Valley Path, Marshfield, Mass. 02050

[21] Appl. No.: 184,293

[22] Filed: Jan. 21, 1994

[51] Int. Cl.[6] ..... B60C 25/08

[52] U.S. Cl. ..... 301/5.3; 152/396; 152/409; 280/11.22

[58] Field of Search ..... 280/11.22, 11.23; 301/5.3, 5.7, 105.1, 108.1, 108.4, 29.2; 152/396, 397, 398, 402, 411, 412, 413, 409

[56] References Cited

U.S. PATENT DOCUMENTS

| | | | |
|---|---|---|---|
| 980,607 | 1/1911 | Copenhaver et al. | 152/409 X |
| 2,097,942 | 11/1937 | Whitney | 152/409 X |
| 2,878,071 | 3/1959 | Fowlkes . | |
| 3,968,825 | 7/1976 | Mitchell et al. . | |
| 4,208,073 | 6/1980 | Hechinger . | |
| 4,217,944 | 8/1980 | Pascal . | |
| 4,466,670 | 8/1984 | Kaji . | |
| 4,711,458 | 12/1987 | Shim | 280/11.22 |
| 4,770,220 | 9/1988 | Mori . | |
| 5,018,566 | 5/1991 | Thoni . | |
| 5,129,709 | 7/1992 | Klamer . | |

FOREIGN PATENT DOCUMENTS

| | | | |
|---|---|---|---|
| 640 | of 1906 | United Kingdom | 152/412 |

*Primary Examiner*—Russell D. Stormer
*Attorney, Agent, or Firm*—Cesari and McKenna

[57] ABSTRACT

A skate wheel includes a reusable hub and a replaceable tire. The hub consists of (i) a rim with an integral clamp ring, (ii) an attachable clamp ring that attaches to the rim after a tire is mounted on the rim and (iii) a threaded ring which fastens onto the rim and secures the attachable clamp ring to the rim. Each of the clamp rings includes an inwardly pointing arm. These arms extend into annular grooves on the sides of the tire, to grip the tire and hold it in place on the rim. In a preferred embodiment the outer ring screws onto the rim and in position against the clamp ring, to retain the claim ring on the rim. To replace a worn tire, a user unscrews the outer ring, removes the attachable clamp ring and then removes the old tire from the rim. He then slides a new tire onto the rim, holds the tire in place with the attachable clamp ring and secures that ring in place with the outer ring.

5 Claims, 1 Drawing Sheet

SKATE WHEELS

FIELD OF THE INVENTION

The invention relates generally to wheels for skates and, in particular, to a wheel with a reusable hub.

BACKGROUND OF THE INVENTION

The design of skate wheels has changed considerably as skates have evolved from traditional roller skates, with four wheels arranged in parallel sets of two wheels each, to in-line skates. The in-line skates require rugged, "high performance" wheels, which are narrower than the wheels used in traditional roller skates. These narrower wheels allow skaters to perform, for example, the aerial stunts often associated with in-line skates.

The skate wheels currently used on in-line skates consist of a molded plastic center hub and a hard plastic, typically, urethane, outer section, which is molded directly onto the center hub. The urethane outer section is shaped, or graded, such that the portion that is in contact with the road is relatively narrow in comparison with the portion that is molded to the center hub. These wheels give the skate a fast, smooth ride when they are new. As the wheels wear, however, the narrower portion gives way to the wider portion and more wheel surface is in contact with the road. This results in increased friction, which slows the skates. Also, the wheels tend to wear unevenly because of the side-to-side motion of the skates, which adversely affects the performance of the skate.

Once the wheels wear down to the point where they noticeably and adversely affect the performance of the skate, they must be replaced. The user discards the four wheels and attaches four new wheels. These wheels are relatively expensive, both because of the materials used to make the wheels and because of the two-step molding process, that is, the molding of the center hub and then the molding of the urethane outer section onto the hub.

SUMMARY OF THE INVENTION

The invention is a skate wheel which consists of a reusable hub and a plastic, preferably urethane, tire. The hub consists of a rim with an integral clamp ring, and an attachable clamp ring and an outer ring that fasten to the rim after the tire is mounted thereon. The rim includes threads for receiving the outer ring, which fits within the attachable clamp ring and secures that ring, and thus, the tire to the rim. Each clamp ring includes an inwardly facing arm that grips the tire and retains the fire in position on the rim.

The tire is relatively narrow and includes on either side an annular groove around its center orifice. Each groove receives the arm of the adjacent clamp ring. The tire can be narrower than the urethane sections of the wheels currently in use, because of the interconnection of the tire and the reusable hub. Accordingly, as the urethane tire wears it tends to maintain a narrow riding surface for a longer period of time. This tire thus does not require as frequent replacement as the conventional wheel which, as it wears, presents a wider riding surface to the roadway.

When the tires are worn, a user replaces the tire and re-uses the hub. This is far less expensive than replacing the conventional wheels, because only the urethane tire is replaced.

BRIEF DESCRIPTION OF THE DRAWINGS

The above and further advantages of the invention may be better understood by referring to the following description in conjunction with the accompanying drawings, in which.

DETAILED DESCRIPTION OF AN ILLUSTRATIVE EMBODIMENT

Figure 1:
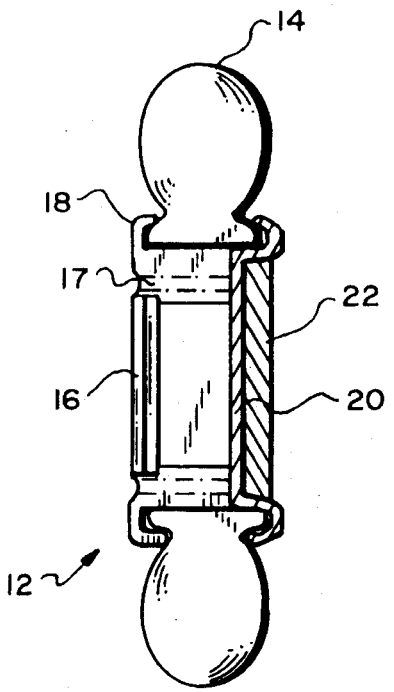
FIG. 1 is a cross-sectional view of a wheel constructed in accordance with the invention.

FIG. 1 depicts a wheel 10 which includes a reusable hub 12 and a plastic, preferably urethane, tire 14. The hub consists of a rim 16 with an integral clamp ring 18 for receiving and gripping the tire 14, and an attachable clamp ring 20 and an outer ring 22 that fasten to the rim 16 after the tire 14 is mounted thereon. The attachable clamp ring 20 holds the tire in place on the rim 16 and the outer ring 22 secures the clamp ring 20 to the rim 16.

Figure 2:
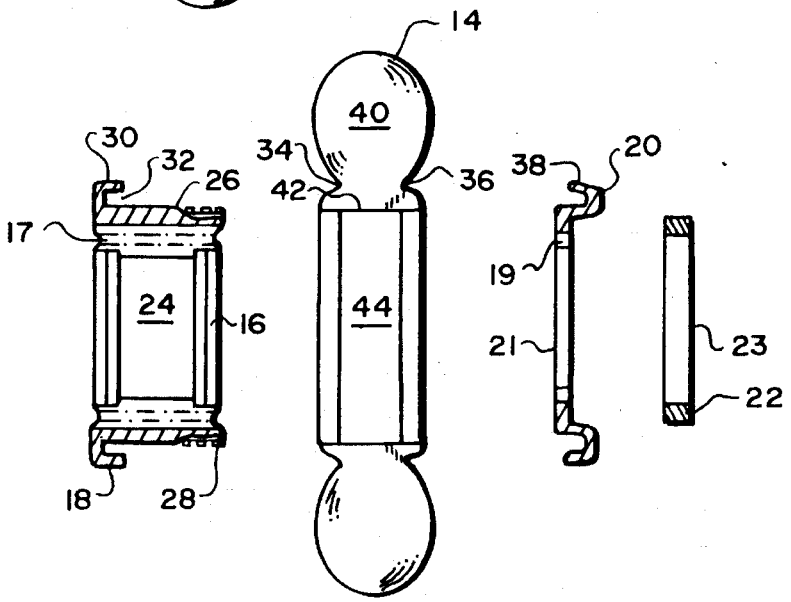
FIG. 2 is an exploded view of the wheel of FIG. 1.

Referring also to FIG. 2, the rim 16 is essentially O-shaped, with a hollow interior 24 that accommodates an axle (not shown). The rim includes an elongated wall 26 that at one end connects to the integral clamp ring 18 and in the preferred embodiment includes at the opposite end threads 28 that engage threads 23 of the outer ring 22 when the hub is assembled. The rim 16 may include a series of spaced, stylizing holes 17, shown in more detail in FIG. 3. These holes reduce the weight of the wheel and, also, help cool it.

The integral clamp ring 18 includes an inwardly pointing arm 30 that grips the tire 14 by engaging all annular groove 34, as discussed below. Between this arm and the exterior wall 26 of the rim 16 is a recess 32 for receiving the tire 14.

The attachable clamp ring 20 includes a recessed center band 21 that fits around the rim 16 and an inwardly pointing arm 38 that grips the tire 14 by engaging an annular groove 36, as discussed below.

The tire 14 includes a narrow tread section 40. An inwardly facing wall 42 of the tread section 42 defines an orifice 44, which receives the rim 16. The annular grooves 34 and 36 on either side of the exterior of the tread section 40 receive, respectively, the inwardly pointing arm 30 of the integral clamp ring 18 and the inwardly pointing arm 38 of the attachable clamp ring 20.

The outer ring 22, as discussed above, includes threads 23 that screw onto the threads 28 of the rim. This ring 22 has an outer diameter that is smaller than the outer diameter of the attachable clamp ring 20 and an inner diameter that is slightly larger than the inner diameter of the ring 20. Accordingly, when the outer ring 22 is in place on the rim 16, it rests against the recessed center band 21 of the ring 20 and holds the ring 20 in place on the rim 16.

The tire 14 can be narrower than the urethane outer sections of prior known wheels, because of the interconnection of the tire 14 and the reusable hub 12. Accordingly, as the tire 14 wears, it presents to a roadway a relatively narrow riding surface. The tire 14 can thus be used for a longer period of time than prior known wheels, without wearing to a wide riding surface. The width of the tire 14, however, must be balanced against its desired useful life. If the tire is too narrow, it will relatively quickly wear down toward the rim 16. Regardless of the frequency of replacement, the tire 14 is less expensive to replace than the prior known wheels.

Figure 3:
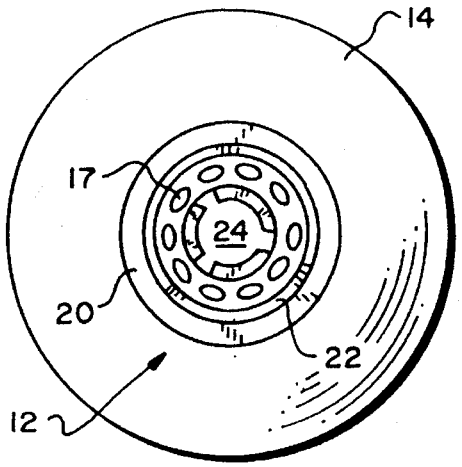
FIG. 3 is a side view of the wheel of FIG. 1.

As depicted in FIG. 3, the threaded ring 22 preferably includes receiving holes 23. A wrench (not shown) with a plurality of prongs shaped to mate with the holes 23 is used to rotate the ring, so that the ring can be readily tightened to fasten the clamp ring 20 to the rim and thereafter loosened to release the it. The holes 23 may be replaced by a plurality of shaped projections, and the multiple-pronged wrench by a wrench with appropriately shaped recesses.

When the tire 14 becomes sufficiently worn, a user replaces the tire by unscrewing the threaded ring 22, removing the attachable clamp ring 20 and sliding the tire 14 from the rim. The user then replaces the worn tire with a new tire and re-assembles the rings 20 and 22 on the rim 16. The user thus purchases only a new tire and re-uses the hub 12, saving both money and raw materials. This is in contrast to a user with skates having prior known wheels, who must replace the entire wheel.

The foregoing description has been limited to a specific embodiment of this invention. It will be apparent, however, that variations and modifications may be made to the invention, with the attainment of some or all of its advantages. Therefore, it is the object of the appended claims to cover all such variations and modifications as come within the true spirit and scope of the invention.

What is claimed is:

1. A wheel for skates, the wheel including:

A. a hub for attaching the wheel to the skate, said hub including i. a hollow rim with an integral clamp ring, the ring including an inwardly pointing first arm for gripping a tire and a center action that extends inwardly from the clamp ring, ii. an attachable clamp ring that slideably mounts on the center section of the rim, the ring including an inwardly pointing second arm for gripping a tire, the clamp ring sliding unimpeded onto the center section until the arm rests against the tire; and iii. an outer ring that reacts against the attachable clamp ring and fastens to the center section of the rim, the outer ring applying to the slideably-mounted attachable clamp ring a force that is sufficient to hold the tire in place the attachable clamp ring being prevented from further movement onto the center section only by the tire; and B. a hardened tire that mounts on the rim before the attachable claim ring is slideably mounted on the rim, the tire including annular grooves that receive the inwardly pointing arms of the clamp rings.

2. The wheel of claim 1, wherein a. the rim includes on the center section, at an end opposite the integral clamp ring, threads for receiving the outer ring; and b. the outer ring is a threaded ring that screws onto the rim.

3. The wheel of claim 2, wherein the attachable clamp ring includes a recess into which the outer ring fits.

4. A reusable hub for a skate wheel, the hub supporting a hardened tire and including:

A. a rim with an integral clamp rang, the ring including an arm for gripping the hardened tire and a center section that extends outwardly from the integral clamp ring in the same direction as the arm, the center section including an outer cylindrical surface and at an end opposite the integral clamp ring screw threads;

B. an attachable clamp ring that slideably mounts on the outer surface of center section of the rim, the ring including an inwardly pointing arm for holding the tire in place on the rim, and attachable clamp ring sliding unimpeded on the cylindrical surface of the center section until the arm meets the hardened tire; and C. an outer ring for screwing onto the threads of the rim the ring securing the attachable clamp ring to the rim and applying a force to the attachable clamp ring that is sufficient to hold the hardened tire in place the attachable clamp ring being prevented from further axial movement on the center section only by the tire.

5. The hub of claim 4, wherein the rim and the ring each include threads and the outer ring screws onto the rim.

* * * * *